US006911613B1

(12) United States Patent
Chuang

(10) Patent No.: US 6,911,613 B1
(45) Date of Patent: Jun. 28, 2005

(54) KEY SWITCH AND KEYBOARD EQUIPPED WITH SUCH KEY SWITCH

(75) Inventor: Wen-Chao Chuang, Taipei (TW)

(73) Assignee: Behavior Tech Computer Corporation, Taipei (TW)

( * ) Notice: Subject to any disclaimer, the term of this patent is extended or adjusted under 35 U.S.C. 154(b) by 0 days.

(21) Appl. No.: 10/988,519

(22) Filed: Nov. 16, 2004

(51) Int. Cl.[7] ..... H01H 13/70
(52) U.S. Cl. ..... 200/344
(58) Field of Search ..... 200/5 A, 517, 200/344, 345; 400/490, 491, 491.2, 495, 495.1, 496

(56) References Cited

U.S. PATENT DOCUMENTS 5,767,468 A * 6/1998 Tsai ..... 200/344
5,898,145 A * 4/1999 Su ..... 200/344
6,366,275 B1 * 4/2002 Lai ..... 200/344
6,504,120 B2 * 1/2003 Hsu ..... 200/344
6,633,012 B2 * 10/2003 Hsu ..... 200/344
6,642,466 B1 * 11/2003 Lu ..... 200/344
6,713,700 B2 * 3/2004 Hsu ..... 200/344
6,805,507 B2 * 10/2004 Tsai ..... 200/345

* cited by examiner

*Primary Examiner*—Michael A. Friedhofer

(57) ABSTRACT

A key switch includes: an outside frame in the shape of a hollow square, a protruded post at each of two ends of a first side of the outside frame, the protruded post being capable of sliding inside a slide slot on a key top, and a hinge part at each of two ends of a second side of the outside frame, the hinge part being hinged to a fixing slot on a bottom plate; an inside frame is inter-hinged to the outside frame, forming a square shape, having a hinge rod at a middle section of the first side, the hinge rod being capable of sliding inside the slide slot on the bottom plate, and a square-shaped snap part at each of two ends of the second side, the snap part being snapped and fastened in a snap slot on the key top; the key top has at least a slide slot and a snap slot; the bottom plate has at least a fixing slot and a slide slot.

28 Claims, 8 Drawing Sheets

KEY SWITCH AND KEYBOARD EQUIPPED WITH SUCH KEY SWITCH

FIELD OF THE INVENTION

The present invention relates to a key switch, particularly to a type of key switch that has integrated and sturdy construction to resist compressive and destructive impact from the outside.

BACKGROUND OF THE INVENTION

As shown in FIG. 1, U.S. Pat. No. 5,504,283 has disclosed a key switch 10 comprising a first link member 7 and a second link member 8 that are interlinked to each other and connected with a key top 5, and a substrate 1. However, the first link member 7 and the second link member 8 in the disclosure have one of their ends constructed in the shape of the letter "H", which appears to be of a frail structure. Meanwhile, the structure adopted in the assembly of the first link member 7, the second link member 8, the key top 5 and the substrate 1 also appears to be weak, and may easily be broken or damaged by the compression of an outside force applied to the key switch 10.

In view of the foregoing weakness in the prior art, the present inventor has come up with an innovative key switch to resist compressive and destructive force coming from outside.

SUMMARY OF THE INVENTION

It is the objective of this invention to provide a key switch of integrated and sturdy construction to resist compressive and destructive force from the outside. It is another objective of this invention to provide a key switch to prevent destruction of all components already assembled inside the key switch when the key top is pulled upwardly by an outside force.

It is yet another objective of this invention to provide a keyboard that adopts the present invention of the key switch in its application, that is connected to a desktop computer, or is built inside a notebook computer.

To achieve the above objectives, the present invention provides a key switch comprising: an outside frame in the shape of a hollow square, the frame having a protruded post at each of two ends of a first side thereof, the protruded post being capable of sliding in a slide slot on a key top, and a square-shaped hinge part at each of the two ends of a second side, the hinge part being hinged to a fixing slot on a bottom plate; an the inside frame is inter-hinged to the outside frame, forming a square shape, having a hinge rod at a middle section of the first side, the hinge rod being capable of sliding inside the slide slot on the bottom plate, and a square-shaped snap part at each of the two ends of the second side, the snap part being snapped and fastened in a snap slot on the key top; the key top has at least a slide slot and a snap slot; the bottom plate has at least a fixing slot and a slide slot.

BRIEF DESCRIPTION OF THE DRAWINGS

The above objects and advantages of the present invention will become more apparent with reference to the appended drawings wherein.

DETAILED DESCRIPTION OF THE INVENTION

Figure 1:
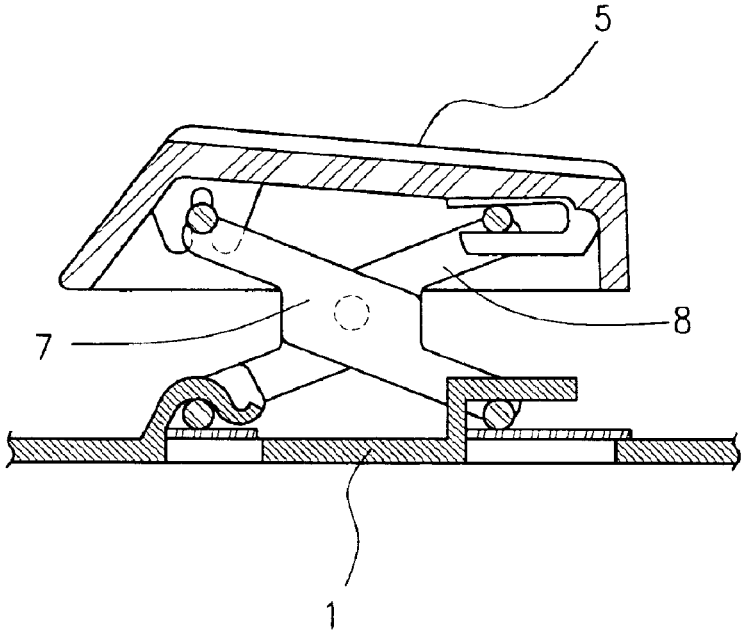
FIG. 1 (PRIOR ART)
FIG. 1 is a schematic view of the prior art of the key switch.
Figure 2:
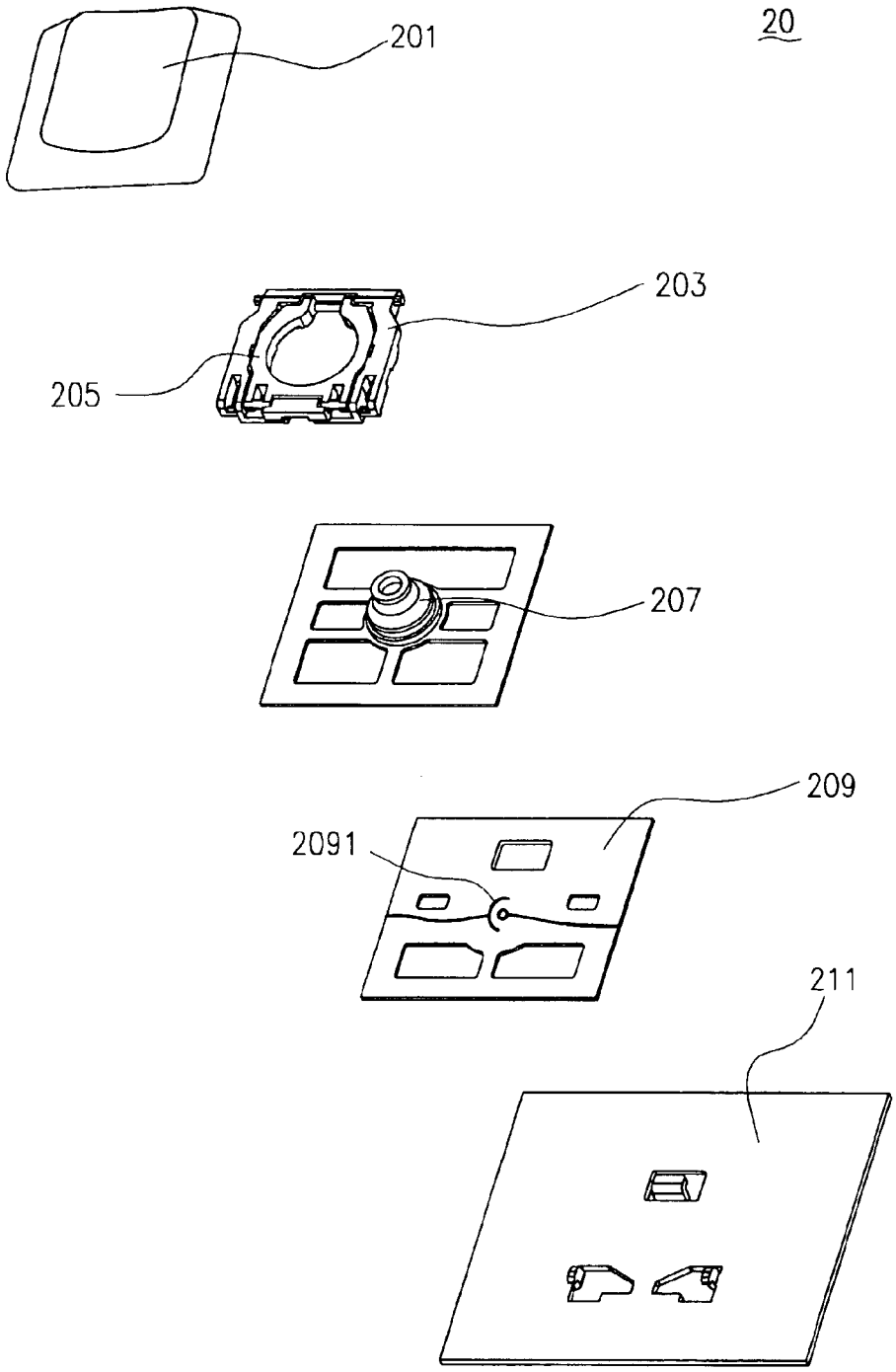
FIG. 2 is an exploded view of the present invention of the key switch.
Figure 3:
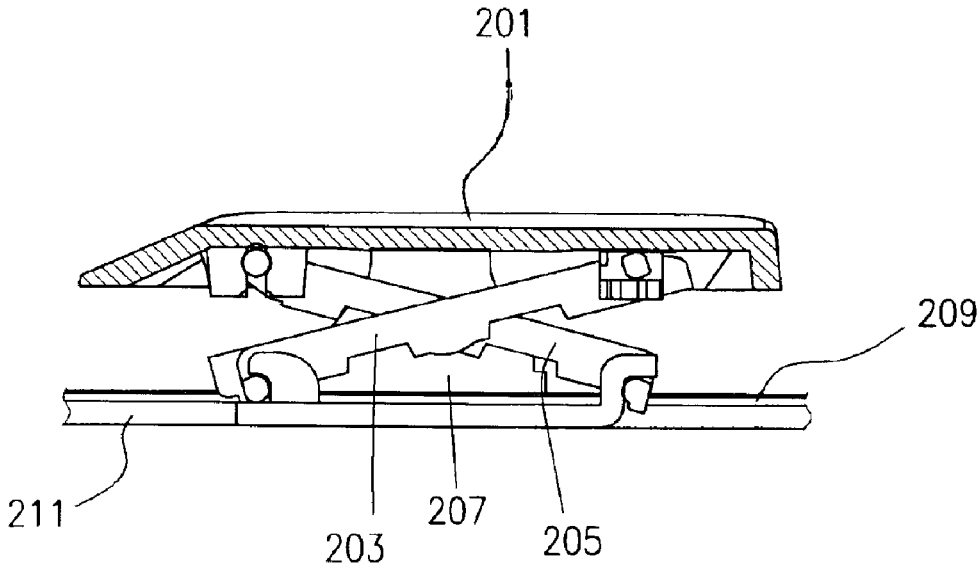
FIG. 3 is a lateral plan view of the present invention of key switch.

FIG. 2 shows an exploded view of the present invention of key switch. FIG. 3 shows a lateral plan view of the present invention of key switch. The invention of key switch 20 comprises, in order from top to bottom, a key top 201, an outside frame 203, an inside frame 205, a flexible member 207, a flexible circuit board 209 and a bottom plate 211; wherein the outside frame 203 and the inside frame 205 are inter-hinged to each other. The bottom plate 211 and the key top 201 respectively have slide slots 2111 and slide slots 2011 to hold the assembly of the outside frame 203 and the inside frame 205, so that when the key top 201 is depressed or restored to its original position, the outside frame 203 and the inside frame 205 are capable of sliding inside the slide slots 2111 and the slide slots 2011. The bottom plate 211 and the key top 201 respectively have fixing slots 2113 and snap slots 2013, to respectively hold the outside frame 203 and the inside frame 205. The key top 201 penetrates the inter-hinged outside frame 203 and inside frame 205 and reaches to the bottom of the key top 201.

When the key top 201 is depressed, the flexible member 207 is driven by the downward force to come into contact with the flexible circuit board 209. Since the flexible circuit board 209 is installed with a circuit contact point 2091, the pressure and contact of the flexible member 207 cause electrical connection to the circuit contact point 2091, thereby creating key-pressing signals.

Figure 4A:
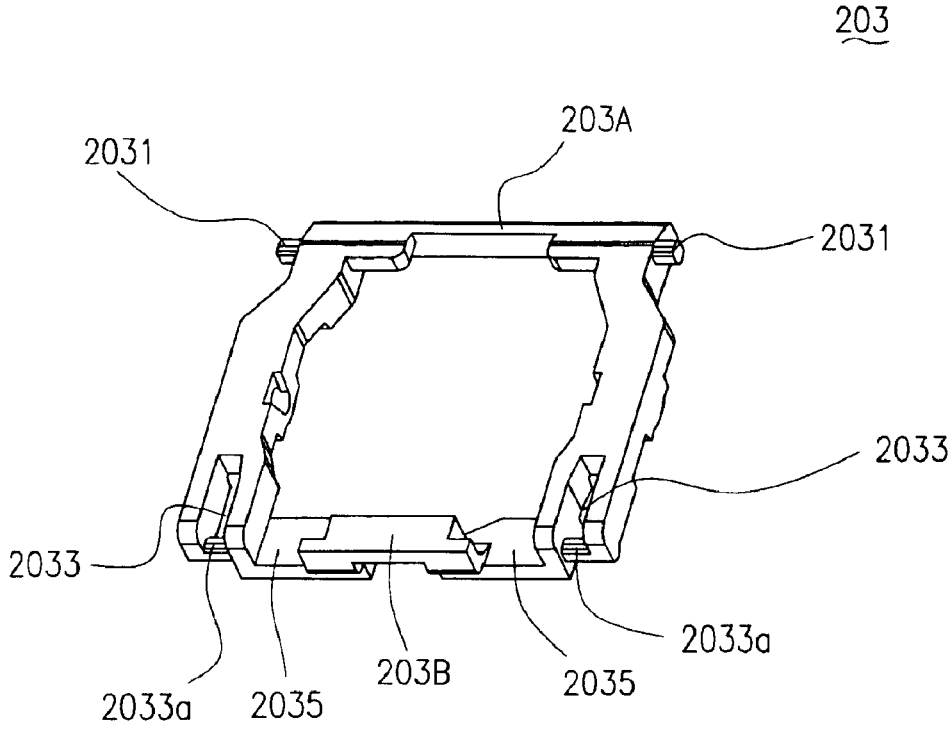
FIG. 4A is a schematic view of the outside frame.
Figure 4B:
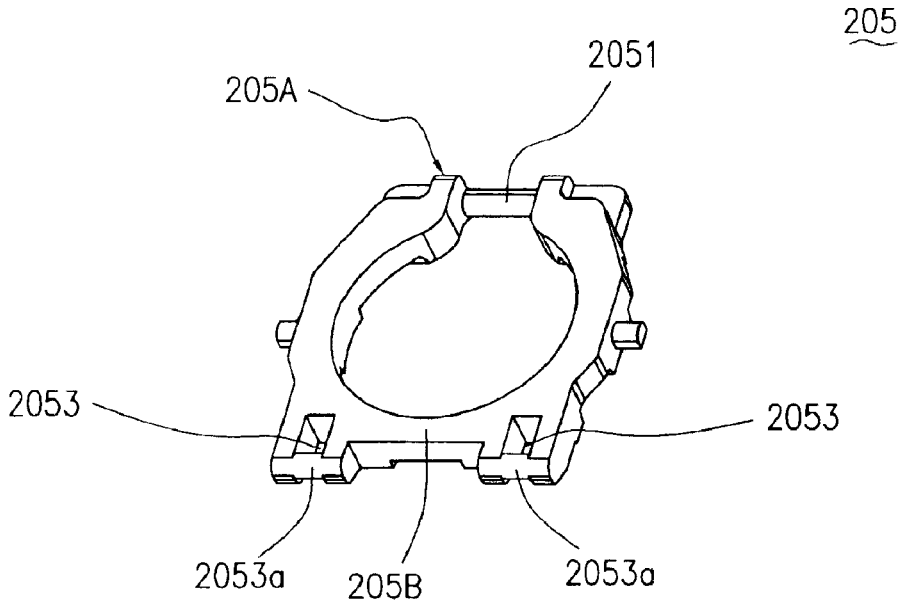
FIG. 4B is a schematic view of the inside frame.

FIG. 4A shows a schematic view of the outside frame 203, and FIG. 4B shows a schematic view of the inside frame 205. The outside frame 203 and the inside frame 205 of the invention have the shape of roughly a square frame. Since the fours sides of the outside frame 203 and the inside frame 205 are joined together, forming an enclosed square frame, such an enclosed square structure is capable of withstanding a larger pressure without breaking or destroying the outside frame 203 and the inside frame 205. The outside frame 203 has a first side 203A, and a protruded post 2031 at each of two ends of the first side 203A, the protruded post 2031 reaching into and capable of sliding within the interior of the slide slot 2011 of the key top 201. The outside frame 203 has a second side 203B, and a square-shaped hinge part 2033 at each of two ends of the second side 203B, the hinge parts 2033 serving to be connected with fixing slots 2113 on the bottom plate 211. Since the four sides of the hinge parts 2033 are joined to form a sturdy construction and resist unwanted outside force that may cause damage to the hinge parts 2033 and result in disengagement of the hinge parts 2033 from the fixing slots 2113 on the bottom plate 211.

The inside frame 205 and the outside frame 203 are inter-hinged to each other. The inside frame 205 has a hinge rod 2051 installed at a middle section of the first side 205A. The hinge rod 2051 is linked to the slide slot 2111 on the bottom plate 211, capable of sliding inside the slide slot

2111. The inside frame 205 has a second side 205B, and a snap part 2053 installed at each of two ends of the second side 205B. The snap part 2053 is shaped as a hollow square, and the snap part 2053 has a snap rod 2053*a* fastened to the snap slot 2013 on the key top 201.

Furthermore, the outside frame 203 is hinged to the key top 201 on the protruded post 2031, the inside frame 205 is hinged to the bottom plate 211 on the hinge rod 2051, and the hinge part 2033 of the outside frame 203 is in contact with the bottom plate 211 on the cross rod 2033*a*; the present invention further makes an arched face of contact between the slide slot 2011 and the protruded post 2031, an arched face of contact between the slide slot 2111 and the hinge rod 2051, and an arched face of contact between the fixing slot 2113 and the cross rod 2033*a*; but there is no limitation on the shape of other faces not in contact.

Furthermore, the inside frame 205 is inter-hinged to the interior of the outside frame 203, and the height of the inside frame 205 after they are hinged shall not be higher than the height of the outside frame 203.

Figure 5:
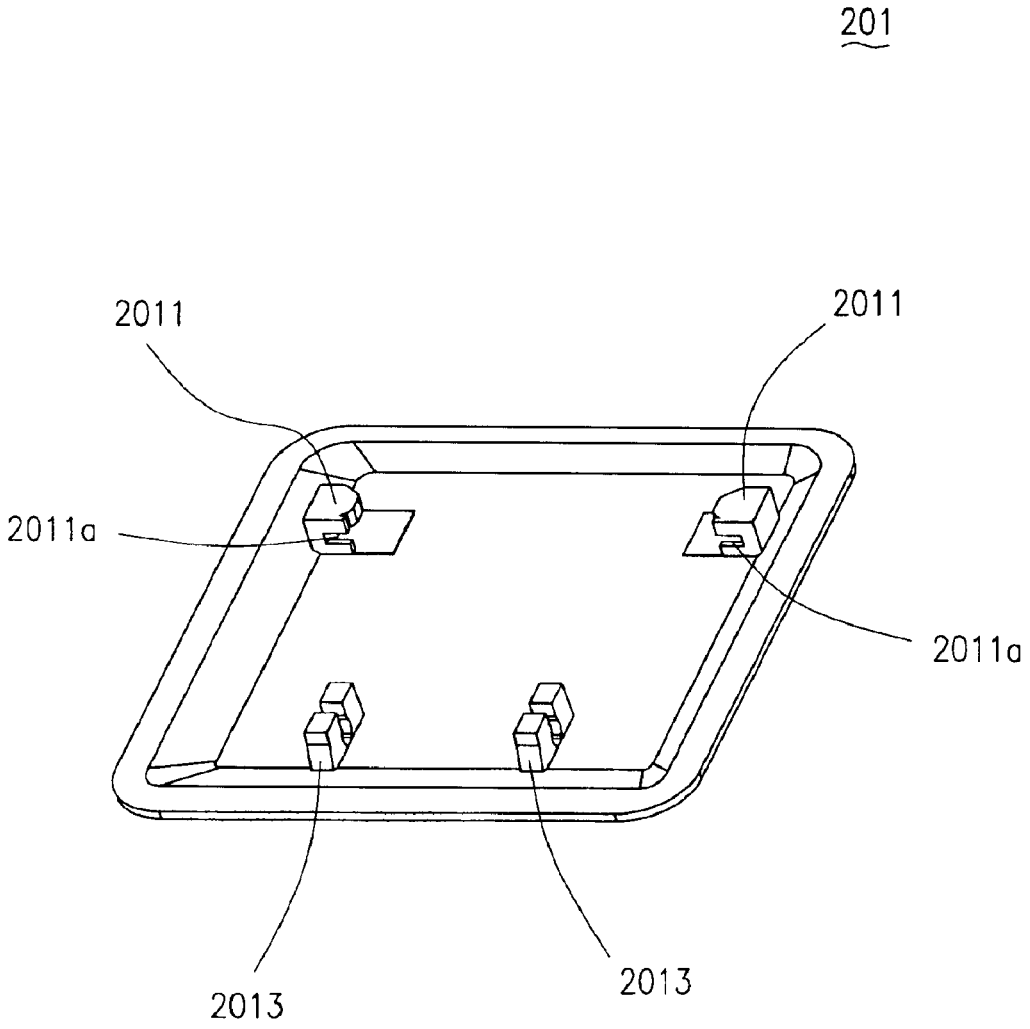
FIG. 5 is a schematic view of the bottom of the key top.

FIG. 5 shows a schematic view of the bottom of the key top 201. On two sides of the bottom of the key top 201 are respectively installed with slide slots 2011 and snap slots 2013. As described above, the slide slot 2011 is hinged to the protruded post 2031 of the outside frame 203, and the snap slot 2013 used to fasten the snap rod 2053*a* of the inside frame 205. The present invention places an emphasis on the key top 201 where an open slot 2011*a* is provided on the slide slot 2011, the open slot 2011*a* forming a side wall for the slide slot 2011. The open slot 2011*a* is designed to serve the following function. When the key top 201 is pulled up by an outside force, such as for the purpose of replacing a new key top, accidentally pulling on the key top 201 will result in destruction to the structure of the inside frame 205 and the outside frame 203, since the key top 201 is structurally linked to move along with the outside frame 203 and the inside frame 205, resulting in disintegration of the inside frame 205 and the outside frame 203. The open slot 2011*a* provided on the slide slot 2011 is designed to avoid such disintegration, so that, when the key top 201 is pulled up by an outside force accidentally, the protruded post 2031 on the outside frame 203 is capable of escaping through the open slot 2011*a* and out of the slide slot 2011, thereby avoiding destruction to the inter-hinged inside frame 205 and outside frame 203.

Figure 6:
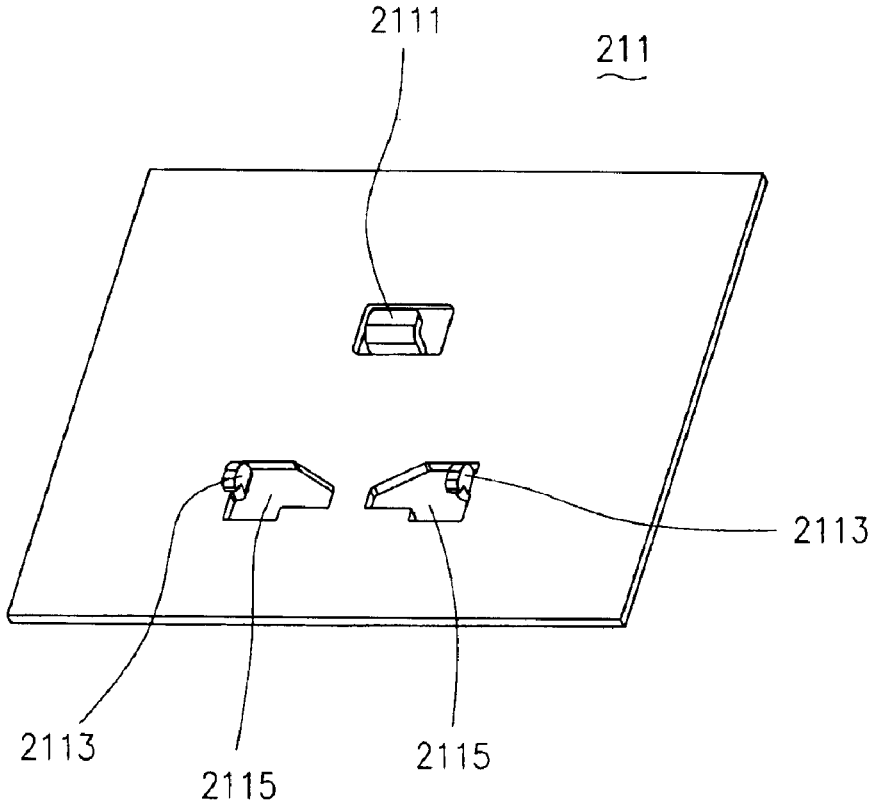
FIG. 6 is a schematic view of the bottom plate.

FIG. 6 shows a schematic view of the bottom plate. The bottom plate 211 has a slide slot 2111 and fixing slots 2113. As described above, the slide slot 2111 is hinged to the hinge rod 2051 of the inside frame 205, and the fixing slots 2113 are hinged to the hinge parts 2033 of the outside frame 203. An important characteristic of the present invention lies in openings 2115 on the bottom plate 211, and two recesses 2035 provided at a middle section of the second side 203B of the outside frame 203. To assemble, the recesses 2035 are respectively pressed into the openings 2115. The main function of the recesses 2035 and the openings 2115 after the assembly lies in that, the protruded post 2031 on the outside frame 203 is capable of moving simultaneously when the outside frame 203 is moving up and down, because of the positioning function of the recesses 2035 and the openings 2115, the outside frame is capable of steadily moving up and down without wobbling left and right. The material of the bottom plate 211 is a flexible thin plate, or a thin metal plate.

Figure 7:
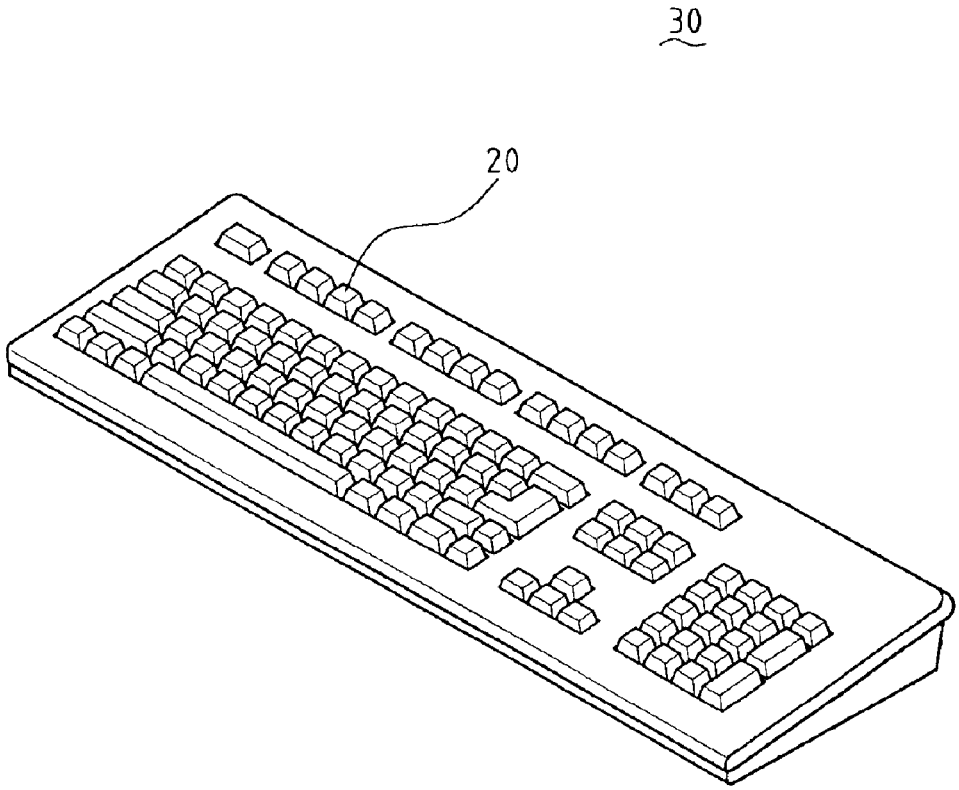
FIG. 7 is a first embodiment view of the keyboard equipped with the invention of key switch.
Figure 8:
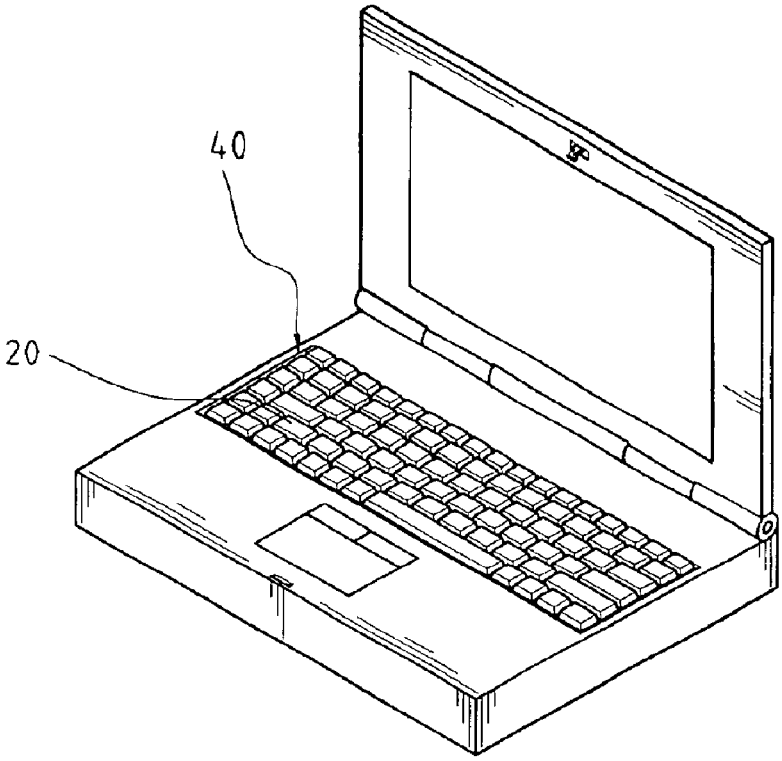
FIG. 8 is a second embodiment view of the keyboard equipped with the invention of key switch.

FIG. 7 shows a keyboard including the first embodiment of the present invention of the key switch. FIG. 8 shows a keyboard including the second embodiment of the present invention of the key switch. The keyboard 30 has at least one key switch 20; the keyboard 30 serves mainly as an input device for a desktop computer. The keyboard 40 has at least one key switch 20; the keyboard 40 serves mainly as an input device for a notebook computer.

It is to be understood that the foregoing description of the present invention should not be based to restrict the invention, and that all equivalent modifications and variations made without departing from the intent and import of the foregoing description should be included in the following claim.

What is claimed is:

1. A key switch, comprising:

an outside frame, in a hollow square shape, having a protruded post at each of two ends of a first side thereof, the protruded posts being capable of sliding inside slide slots on a key top, and a square-shaped hinge part at each of two ends of a second side thereof, the hinge parts being respectively hinged to fixing slots on a bottom plate;

an inside frame, inter-hinged to the outside frame, in a hollow square shape, having a hinge rod at a middle section of a first end thereof, the hinge rod being capable of sliding in the slide slot on the bottom plate, and having a square-shape snap part at each of two ends of a second side thereof, the snap parts being snapped and fastened in snap slots on the key top;

the key top has at least the slide slots and the snap slots; and the bottom plate has at least the fixing slots and the slide slot.

2. The key switch as claimed in claim 1, wherein, the outside frame has two recesses at a middle section of the second side thereof, the recesses being respectively pressed into open slots on the bottom plate.

3. The key switch as claimed in claim 2, wherein, the bottom plate further has the open slots.

4. The key switch as claimed in claim 1, wherein, each of the slide slots on the key top further has an open slot on a side wall thereof, so designed that when the key top is pulled up by an outside force, the protruded posts on the outside frame are capable of escaping the slide slots, thereby avoiding destruction to the already inter-hinged inside frame and the outside frame.

5. The key switch as claimed in claim 1, wherein, the bottom plate is a flexible thin plate.

6. The key switch as claimed in claim 5, wherein, the flexible thin plate is a thin metal plate.

7. The key switch as claimed in claim 1, wherein, each of the protruded posts has a face in contact with the respective slide slot that is an arched face of contact.

8. The key switch as claimed in claim 7, wherein, other faces of the protruded posts are not limited in their shapes.

9. The key switch as claimed in claim 1, wherein, the hinge rod has a face in contact with the slide slot that is an arched face of contact.

10. The key switch as claimed in claim 9, wherein, other faces of the hinge rod are not limited in their shapes.

11. The key switch as claimed in claim 1, wherein, each of the hinge parts includes a cross rod, wherein the cross rod has a face in contact with the fixing slot that is an arched face of contact.

12. The key switch as claimed in claim 11, wherein, other faces of the cross rod are limited in their shapes.

13. The key switch as claimed in claim 1, wherein, the inside frame is inter-hinged to an interior of the outside frame, the inside frame being no higher than the outside frame after they are inter-hinged to each other.

14. A keyboard, comprising at least one key switch, the key switch comprising:

an outside frame, in the shape of a hollow square, having a protruded post at each of two ends of a first side thereof, the protruded posts being capable of sliding in slide slots on a key top, and having a square-shaped hinge part at each of two ends of a second side thereof, the hinge parts being hinged to fixing slots on a bottom plate;

an inside frame inter-hinged to the outside frame, in a hollow square shape, having a hinge rod at a middle section of a first side thereof, the hinge rod being capable of sliding in a slide slot of the bottom plate, and having a square-shaped snap part at each of two ends of a second side thereof, the snap parts being snapped and fastened in snap slots on the key top;

the key top has at least the slide slots and the snap slots;

the bottom plate has at least the fixing slots and the slide slot.

15. The keyboard as claimed in claim 14, wherein, the outside frame has two recesses at a middle section of the second side thereof, the recesses being pressed into open slots on the bottom plate.

16. The keyboard as claimed in claim 15, wherein, the bottom plate further has the open slots.

17. The keyboard as claimed in claim 14, wherein, each of the slide slots on the key top further has an open slot on a side wall thereof, so that when the key top is pulled up by an outside force, the protruded posts on the outside frame are capable of escaping through the open slots and out of the slide slots, thereby avoiding destruction to the already inter-hinged inside frame and outside frame.

18. The keyboard as claimed in claim 14, wherein, the bottom plate is a thin flexible plate.

19. The keyboard as claimed in claim 18, wherein, the thin flexible plate is a thin metal plate.

20. The keyboard as claimed in claim 14, wherein, each of the protruded posts has a face in contact with the respective slide slots that is an arched face of contact.

21. The keyboard as claimed in claim 20, wherein, other faces of the protruded posts are not limited in their shapes.

22. The keyboard as claimed in claim 14, wherein, the hinge rod has a face in contact with the slide slot that is an arched face of contact.

23. The keyboard as claimed in claim 22, wherein, other faces of the hinge rod are not limited in their shapes.

24. The keyboard as claimed in claim 14, wherein, each of the hinge parts includes a cross rod, wherein the cross rod has a face in contact with the fixing slot that is an arched face of contact.

25. The keyboard as claimed in claim 24, wherein, other faces of the cross rod are not limited in their shapes.

26. The keyboard as claimed in claim 14, wherein, the inside frame is hinged to an interior of the outside frame, the inside frame after being inter-hinged being no higher than the outside frame.

27. The keyboard as claimed in claim 14, wherein, the keyboard is used in connection to a desktop computer.

28. The keyboard as claimed in claim 14, wherein, the keyboard is built inside a notebook computer.

* * * * *